US007341014B2

(12) United States Patent
Smith

(10) Patent No.: US 7,341,014 B2
(45) Date of Patent: Mar. 11, 2008

(54) SYSTEM FOR LIFTING AND LOWERING A SAILBOAT MAST

(76) Inventor: Anthony J. Smith, 2512 Lyon Dr., Annapolis, MD (US) 21403

( * ) Notice: Subject to any disclaimer, the term of this patent is extended or adjusted under 35 U.S.C. 154(b) by 0 days.

(21) Appl. No.: 11/655,093

(22) Filed: Jan. 19, 2007

(65) Prior Publication Data

US 2008/0035042 A1 Feb. 14, 2008

Related U.S. Application Data

(60) Provisional application No. 60/792,967, filed on Apr. 19, 2006.

(51) Int. Cl.
*B63B 15/00* (2006.01)
*B63H 9/04* (2006.01)

(52) U.S. Cl. ..... 114/90; 114/102.1

(58) Field of Classification Search ..... 114/39.32, 114/61.1, 89–101, 102.1, 102.11–102.19, 114/102.2, 102.21, 102.29
See application file for complete search history.

(56) References Cited

U.S. PATENT DOCUMENTS

| | | | | |
|---|---|---|---|---|
| 145,645 | A | 12/1873 | Hammond | |
| 457,323 | A | 8/1891 | Matthews | |
| 477,477 | A | 6/1892 | Uhlig | |
| 3,141,435 | A | 7/1964 | Moffit, Jr. | |
| 3,507,240 | A | 4/1970 | Butler | |
| 3,827,386 | A | 8/1974 | Faden | |
| 3,898,948 | A | 8/1975 | Huff | |
| 4,112,861 | A | 9/1978 | Lewis | |
| 4,655,154 | A | 4/1987 | Leonard | |
| 4,718,370 | A | 1/1988 | Portell-Vila | |
| 4,940,008 | A | 7/1990 | Hoyt | |
| 5,601,044 | A * | 2/1997 | Hara | 114/39.29 |
| 5,865,136 | A | 2/1999 | Alexander | |

FOREIGN PATENT DOCUMENTS

FR 2664559 A * 1/1992

* cited by examiner

*Primary Examiner*—Lars A. Olson
*Assistant Examiner*—Daniel V. Venne
(74) *Attorney, Agent, or Firm*—James Creighton Wray; Clifford D. Hyra

(57) ABSTRACT

A system for one person raising and lowering the mast of a sailboat wherein the mast is less than about forty feet in length and in the down position the mast is laid horizontally along a median line of the hull of a sailboat. The system includes rigging to raise the height of the mast from the hull and then to pivot the mast with the pivot being near the lowest point of the mast. Means is provided to pivot the mast about the lowest point of the mast until the mast is in a vertical position. The mast is then brought down into an upstanding vertical position with means to support the mast on the sailboat at the mast's lowest point and upwardly therefrom. The same rigging may be used to lower the mast to the horizontal. The operations occur by a winch located towards the rear of the sailboat to either pay out a line thereon when lowering the mast to the horizontal or conversely to take up the line when the mast is pivoted to the vertical.

14 Claims, 6 Drawing Sheets

SYSTEM FOR LIFTING AND LOWERING A SAILBOAT MAST

Priority is based on the Provisional application Ser. No. 60/792,967 filed Apr. 19, 2006

TECHNICAL FIELD OF THE INVENTION

This invention relates to hoisting devices employed on naval vessels; means to raise and lower smoke stacks; means to raise and lower the pylon mounted communication antennas on trucks and means to raise and lower telephone poles. More particularly, this invention relates to a system to enable a single individual to hoist a mast on a sail boat safely and easily without the need for great physical strength or agility. The hoist is adapted for non-permanent installation or permanent installation on most pleasure craft sailboats.

BACKGROUND OF THE INVENTION

Most pleasure craft sailboats have a mast which can be lowered from the upright and vertical position to a horizontal position. With the mast in the horizontal position, the boat can be stored in a low-ceiling protective enclosure, and can be moved over land on a trailer without having the mast interfere with power lines and bridges over roadways. It is desirable for many boat owners to trailer their sailboat to land-based storage to avoid costly water-based marina storage fees.

However, most masts of medium to large size sailboats are fairly heavy and can require three or more men to lift them into the upright and vertical positions before launching the craft from the trailer to the water. For example, a 28-foot mast weighs approximately 200 plus pounds in the vertical position and can reach over 30 feet in length from ground level when in the uptight position. This initial weight can be difficult and dangerous for one or even two men to lift, and the vertical height can interfere with overhead power lines unintentionally.

Correspondingly, to safely lower the mast on the vessel, several men are required again. This need for several men to "put in" and "take out" the craft reduces the independence of the boat owner who may want to sail alone, and can cause considerable safety risk to all involved during the lifting and lowering operations.

Most sailboats do not have a common method for mounting deck accessories such as winches and hoists, so mounting an "after market" mast winch to the deck of sailboats presents a particularly challenging problem.

Therefore, there exists a need in the art to provide a lifting apparatus to allow a single individual of normal human strength and agility to raise and lower a sailboat mast from and to the horizontal storage position to and from the upright and vertical position.

Furthermore, there is a need in the art for this system and method to enhance the safety of the operator of the system over the prior art method of manual lifting and lowering.

Finally, there is a need in the art for this system and method to be easily installed and removed to and from a sailboat, without need for permanent mounting modification or fixtures to the vessel. At the same time those elements that are put in place to carry out the system are at a minimum so that activity on the deck is not circumscribed.

SUMMARY OF THE INVENTION

The object of the present invention is to allow a lone sailboat owner or operator to lift and lower the mast to and from a horizontal and vertical position without the need for additional assistance.

Another object of the invention is to enhance the safety of the mast lifting and lowering operation by allowing the process to be stopped, held, and reversed at any point in the operation.

Another object of the invention is to provide a mounting scheme for the mast hoist which is universally applicable to most sailboats, able to be installed and removed by a single person and does not require permanent modification of the vessel deck or hardware.

A further object of the invention is to allow construction of the hoist device using common, low cost, and light weight materials, with as many common subassemblies as possible to reduce manufacturing cost and maximize portability of the unit for any purpose intended such as mentioned in the above other than the masts of sail boat.

The present invention is an improvement to the mast raising means which was developed to be employed and used with the trimaran disclosed and patented by me in my issued U.S. Pat. No. 6,990,915, entitled Stabilized Water Craft Such As A Trimaran. The invention in said patent pertains to an ingenious means for retracting each of the pontoons located alongside each side of the hull in a direction towards a center thereby reducing the beam to a smaller width whereby the trimaran may by mounted on a trailer for trailering on the highway. It will be noted that the pontoons maintain their horizontal orientation in the their extended position and in the retractable position. The aforementioned patent is incorporated herein by reference in its entirety.

Having made considerable progress with the disclosure as taught by me in the said issued patent it is a further disclosure to provide for a relatively easy and essentially one person means to raise a mast which during trailering is positioned to lie atop the trimaran in a down position. As the mast is deemed to be not only awkward by virtue of its length it is also rather heavy. It has been found to be great boon to be able to raise the mast by employing novel mechanical advantage not heretofore disclosed which is detailed to be included on the super structure of the trimaran. Although at the outset of the exposition of the present invention it is pointed out that the apparatus for raising a mast on a sailboat is not confined to a trimaran of the subject patent, but can be employed to satisfaction with most any sailboat that is devoid of possible interfering super structure, that is, upwardly extending protrusions of an undefined specific type.

For the purpose of describing the set up, please assume a mast having a length of about 36 feet and vertical in sailing position. The mast is held up with a head stay, back stay and side shrouds. There are two spreaders on opposite sides of the mast, each is swept aft about 20 degrees. The lower spreader is about eight feet up in line with attachment by a main frame A. Details in regard to this frame as well as frames B, C and D will be provided below along with their respective functions. The upper spreader is high enough so that it does interfere with the arcuate motion of frame D. The mast is held up with cap shrouds going from the top of the mast and over the upper spreaders to the outer tip of the lower spreaders. The intermediate shrouds go from the mast at the base of the upper spreaders to the outer tips of the lower spreaders. Single shrouds go from the outer tips of the lower spreaders to the chain plates on the cabin sides 18 inches aft of the mast (this is the same connection point as frame A). The connection of the single shrouds to the tips of the spreaders is such that there is a full 180 degree of possible articulation. The lower shrouds are replaced by frame A.

The base of the mast has a plate with curved vertical flanges that take weight of the mast and a fork at the forward end. The mast base slides into a pocket bolted to the deck. The curved vertical flanges allow the mast to rock fore and aft. The fork at the forward end of the mast base is to catch the roller genoa sail as the mast comes down.

There are frames, namely, A, B, C and D. Each of the frames comprise two struts on each side of the mast. The struts are connected to the deck with a wide base. These frames do not allow the mast to move sideways as the mast is coming down or up.

Frame A is the main frame and is thickest at 1 and ¾ inches compared to the others at inch. Frame A replaces the lower shroud, taking compression and tension. Frame A is about 8 and one-half feet long and is pivotally attached to the mast about 8 feet up with a pivot aft of the cabin side chain with a pivot. The base of frame has a mounting that provides at least a ¾ inch adjustment.

Frame B is about 7 feet long and is pivotally mounted at its upper ends to the mast at a pivot about 3 feet up. The other end of frame B is pivotally attached to the deck forward of the mast with a pivot. Frame B has a left and right hand screw threads, so that when turning the middle thereof, there will be adjustment.

Frame C is about 7 feet long pivoted on the same chain plate at the cabin side as frame A. This frame extends aft and is approximately horizontally with a roller its aft end. When trailing frame C is held up off the deck with an 18 inch support prop. When raising the mast, frame C is connected to frame D with a rope and the 18 inch prop is removed, from frame C which assists in keeping the mast in line with the center of the sailboat.

Frame D consists of two spaced apart struts which are about 9 feet long and extends vertically when the mast is up. The base of the frame D is pivoted on the deck just aft of the mast on either side of the mast. The top of the struts of frame D are bent forward above the lower spreader and are connected in front of the mast by a rectangular steel plate of about 5 inches by 2 inches. Frame D, by means of said plate is connected to frame C with a removable rope about 8 feet in length. To the other side of this plate is connected another line which is called the "Control Line" that continues angularly downward and through pulleys in a sheave box at the base of the mast. This control line goes right through the base of the mast. In an aft direction the control line goes aft through a directional pulley on the deck aft of the mast base and then over a sheet winch at the side of the cockpit.

Mast Raising:

In the trailering position with the mast down, the plate of frame D is partially atop of the mast. To raise the mast, pulling on the control line raises frame D to a vertical position. Continuing the pull effort impinges on frame C which is then pulled into a raised position. A further pulling on the control line pulls frame D forward, that in turn raises frame C and raises the mast. A roller on the top of frame C is a buffer and takes the weight of the mast.

As the mast starts to raise, the frames A and B also start to lift. The force need to move the control line is less than 50 pounds per square inch. The total travel of the control line from the mast in the down position to the mast in the raised position is only about 30 feet and vice versa.

When the mast is about 6 feet up, a stop plate that is connected to the control line abuts on the pullet in the sheave box. Still further pulling on the control line then starts to pull the base of the mast aft, The frames C and D are longer helping to raise the mast. The frames A and B now control the further raising of the mast. For a relative short period, the control line increases to about 150 pounds per square inch. However, the load soon diminishes to about 50 pounds per square inch or less. As frames A and B are an unequal parallelogram, continued taking up of the control line moves the mast arcuately into a vertical standing position.

Frame A is behind the mast base and therefore as it goes into position, it lowers the mast onto the mast base. It is a relatively simple matter to connect the head stay. The remainder of the rigging does not need much adjusting, if any.

Lowering the Mast:

Begin by disconnecting the head stay. A small pull on the back stay starts the mast coming aft and lifts the mast out its base receptacle. Easing out the control line permits the base of the mast to go forward. As the base of the mast goes forward the action of the frames A and B rotates the mast, allowing the mast arcuately come down. As the mast comes down the frame C rises. When the mast is almost it rests on the roller of frame C. As frame C takes the load of the mast which is then transferred to frame D. As frame D starts to move, the control line now moves through the sheave of the mast. Continued easing out of the control line allows frame D and C to move, thereby lowering the mast. The mast eventually comes to rest on a provided first support on the roof of the cabin and a second support aft of the mast base. The mast is supported horizontally about 12 inches above the roof of the cabin. The front of the mast comes to rest about three feet forward of the bow. This is the correct position for trailering. The frames A and B rigidify the mast when it is down making the mast secure for easy trailering. The top portion of frame D simply lies in abutment on the mast.

The mast can be raised or lowered with the sails on. The genoa sail, when present, is simply rolled up and stays against the mast when the mast is down. The main sail stays on the boom, which is raised vertically prior to the lowering of mast. When the mast is down the boom with its main sail fits in the foredeck of the sail boat.

Lowering or raising the mast may be easily a one man job that can done directly on the trailer, the water, even when approaching a bridge or some other hazard. The whole procedure takes only minutes.

DETAILED DESCRIPTION OF THE INVENTION

Figure 1:
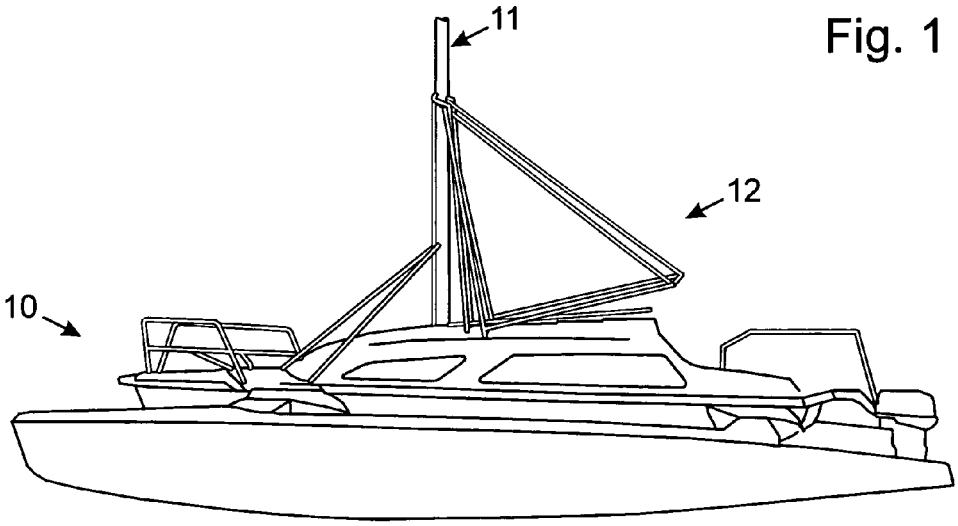
FIG. 1 is a partial side view of a multi-hulled sailboat with its mast in an erect position.
Figure 2:
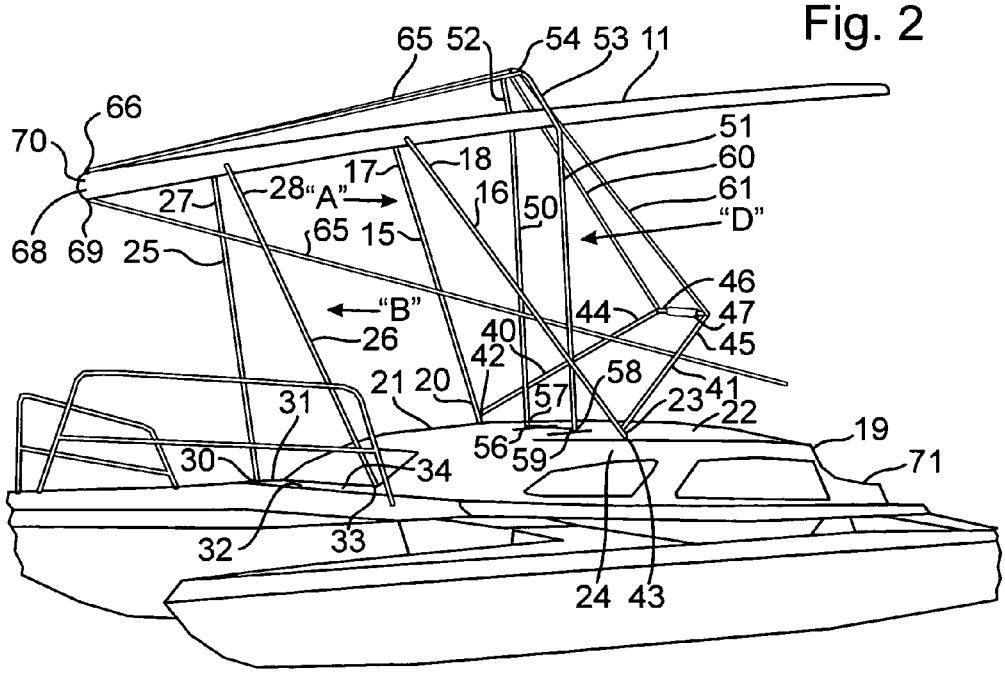
FIG. 2 is a partial rearward looking perspective view of a multi-hulled sailboat with its mast in an intermediate raised position.

FIGS. 1-4 depict a multi-hull sailboat shown, generally, by reference numeral 10. The present invention has equal applicability to mono-hulled sailboats. FIG. 1 illustrates sailboat having a vertically mounted mast 11. While FIG. 1 shows at least portions of the means, generally, 12, for raising and lowering mast 11, attention is directed to FIGS. 2,3, and 4, when reviewed together gives a good understanding of the invention. In each of these Figures the mast 11 is shown in angularity from either the horizontal or vertical so that it is fair to say that the mast 11 is in the middle of being raised or lowered.

Each side of mast 11 is fitted with a first frame, i.e. frame "A", which comprises strut 15 and strut 16. The upper end 17 of strut 15 is pivotally mounted to the starboard side of mast 11 just terminating under a normally positioned lower spreader (not shown in the Figure) which sweeps aft. The upper end 18 of strut 16 is pivotally mounted to the port side of mast 11 in a similar manner. The struts 15 and 16 spread apart in a downward facing V-shaped manner. The other end 20 of strut 15 is pivotally mounted to edge portion 21 of the roof 22 of the cabin 19 of the sailboat. The end 23 of strut 16 is pivotally mounted to the edge portion 24 of the roof 22 of the cabin 19 of the sailboat.

Each side of mast 11 is fitted with a second frame, i.e. frame "B", which comprises strut 25 and strut 26. The upper end 27 of strut 25 is pivotally mounted to the starboard side of mast 11 at about three feet from the base of the mast 11. The upper end 28 of strut 26 is pivotally mounted to the port of mast 11 at about three feet from the base of the mast 11. The struts 25 and 26 spread apart in a downward facing V-shaped manner. The end 30 of strut 25 is pivotally mounted to edge 34 of the deck 32 forward of the cabin 19. The end 33 of strut 26 is pivotally mounted to edge 34 of the deck 32 forward of cabin 19.

The roof 22 aft of the mast 11 is fitted with a third frame, i.e. frame "C", which comprises starboard leg 40 and port side leg 42. The end 42 of leg 40 is pivotally mounted to edge portion of the roof 22 of the cabin 19. The end of leg 41 is pivotally mounted to edge portion 24 of the roof 22 of the cabin 19. From their respective pivots, leg 40 and leg 41 are angled towards each other but their respective ends 44 and 45 by a horizontally disposed bridge 46. A weight absorbing roller 47 is secured around bridge 46.

A fourth frame, i.e. frame "D" is also provided which comprises elongate strut 50 and elongate strut 51 which are longer than any of the struts of the afore mentioned frames. The struts 50 and 51 extend above the lower spreader so that when mast 11 is in a vertical position the strut 50 extends above the lower spreader at the mast's starboard side and strut 51 extends above the lower spreader at the mast's port side. The portions of said struts that extend above the lower spreader are bent so that said bent portion extend forward of said mast 11. End 52 of strut 50 is connected to end 53 of strut 51 by metal rectangle 54. The opposite end 56 of strut 50 is slidably secured to a short track 57 mounted on roof 22 only a short distance from the starboard side of the mast 11 and extending fore and aft of the mast. The opposite end 58 of strut 51 is slidably secured to a short track 59 mounted only a short distance from the port side of the mast 11 and extends for and aft of the mast.

The struts of the first frame must be able to bear the greatest load as a result they have the largest tubular steel of a diameter of 1 and ¾ inches and may undergo shortening or lengthening by known method and/or means. Likewise the struts the second frame, while not requiring the same degree, may be constructed of tubular steel having a 1 inch diameter, are also provided with known means for shortening or lengthening them, so as to provide enhanced rigidity to the mast as with the first frame.

A first line 60 and a second line 6! are tied to the bridge 46 of the third frame in spaced apart manner to provide better balance. The other ends of lines 60 and 61 are tied to the metal rectangle 54 of the fourth frame in a manner whereby the lines 60 and 61 are of the same length.

An end of a line 65 is also tied to the same bridge, i.e. rectangle 54 of the fourth frame. This has been described as the control line elsewhere. A stop 66 is secured about 8 feet down the line. The mast has a sheave box 68 containing a pulley 69 built into the base 70 of the mast 11 access thereto facing fore and aft. Line 65 is payed through the said pulley 69 and is directed through a directional pulley in a known manner to cockpit 71 located to the rear of the sailboat to a suitable winch (not shown). The take up of line 65 by the said winch pulls the base 70 of the mast 11 arcuately downwardly to a support plate 72 mounted on the roof 22 of the cabin as a result of impingement of stop 66 onto said pulley located in the sheave box 68. See FIG. 13.

Figure 3:
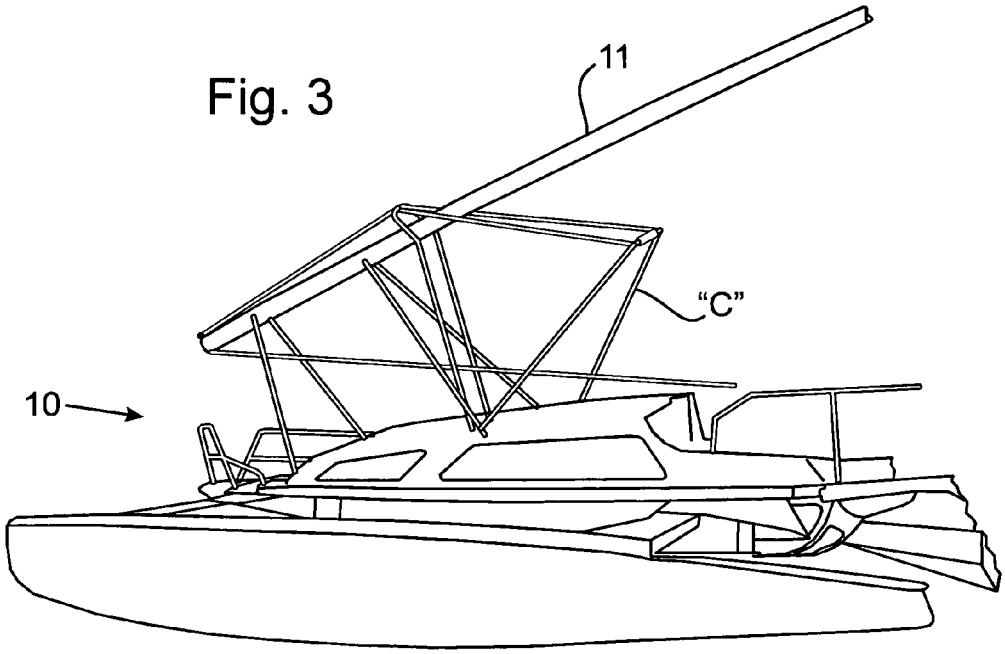
FIG. 3 as a partial forward looking perspective of a multi-hulled sailboat with its mast slightly different from that shown by FIG. 2.
Figure 4:
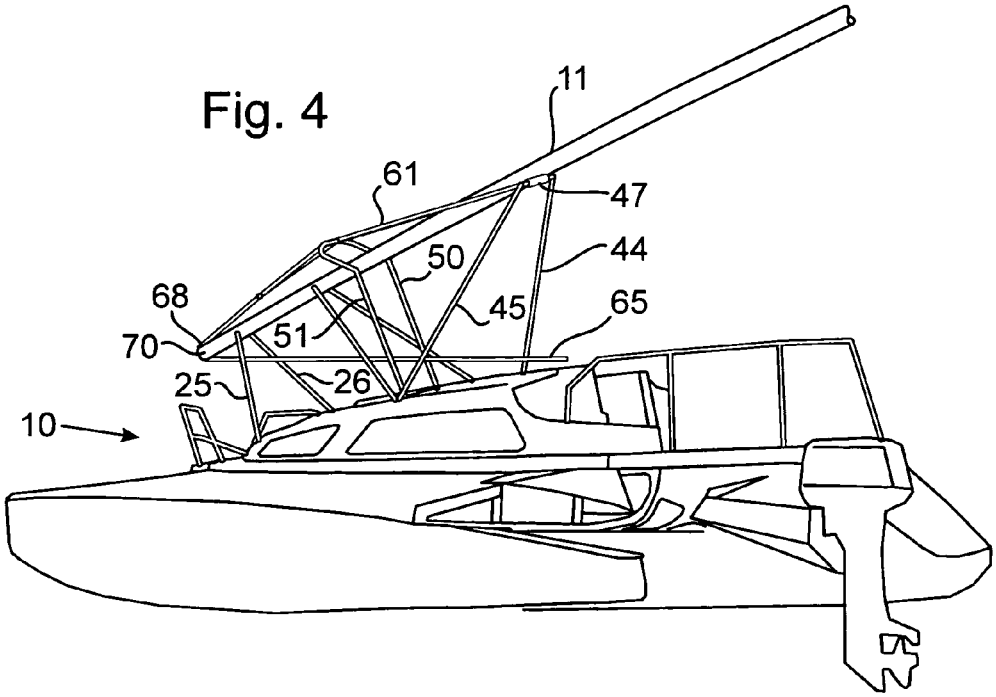
FIG. 4 is a partial forward looking perspective of a multi-hulled sailboat with its mast having advanced to a more vertical position.
Figure 5:
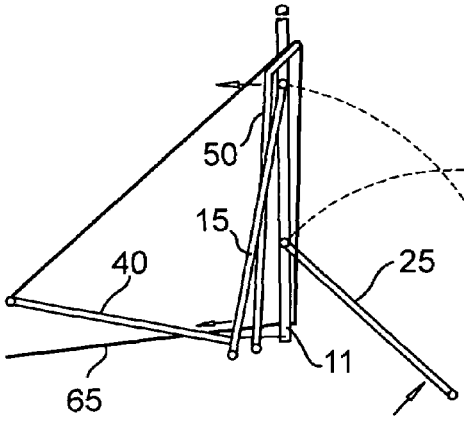
FIG. 5 is a perspective schematic view of the operating components of the invention depicting the mast in its vertical position.
Figure 6:
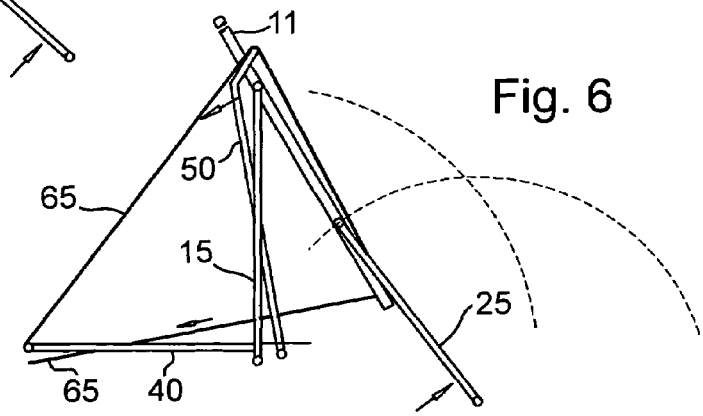
FIG. 6 is a perspective schematic view of the operating components of the invention showing the mast in its initial movement from its vertical position.
Figure 7:
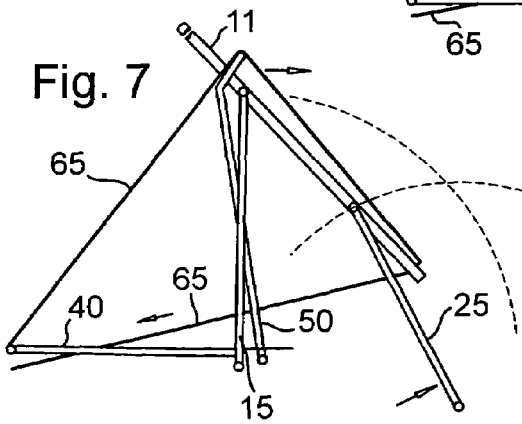
FIG. 7 is a perspective schematic view of the operating components of the invention showing the mast in its subsequent movement towards the horizontal.
Figure 8:
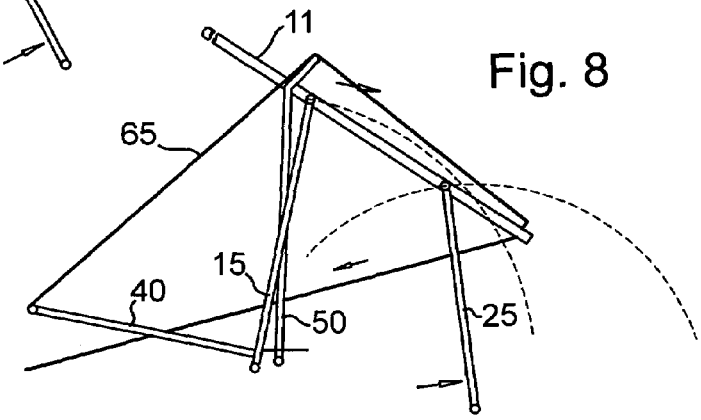
FIG. 8 is a perspective schematic view of the operating components of the invention showing the mast in its still more subsequent movement towards the horizontal.
Figure 9:
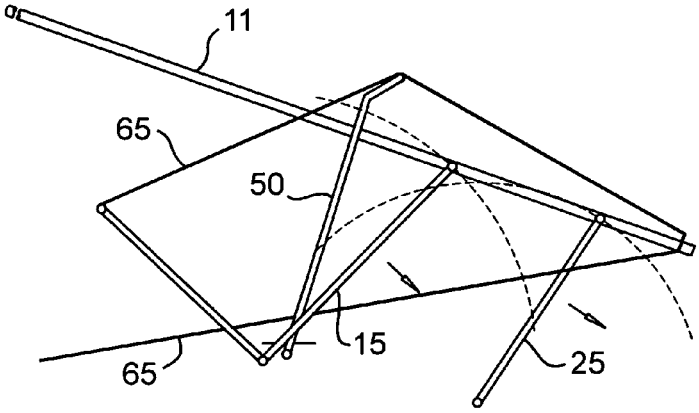
FIG. 9 is a perspective schematic view of the operating components of the invention showing the mast in its yet more subsequent movement towards the horizontal
Figure 10:
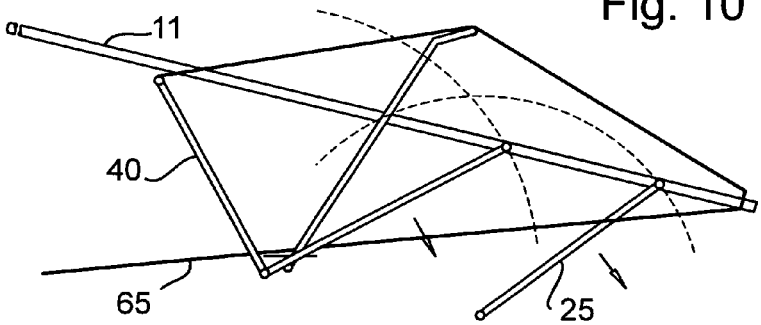
FIG. 10 is a perspective schematic view of the operating components of the invention showing the mast in an even more subsequent movement towards the horizontal.
Figure 11:
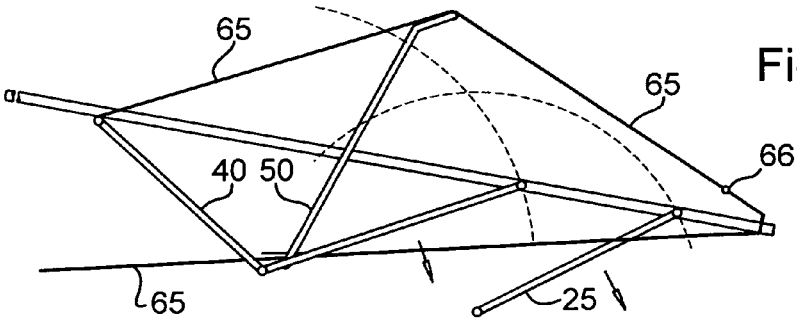
FIG. 11 is a perspective schematic view of the operating components of the invention showing the mast in virtually a horizontal position.
Figure 12:
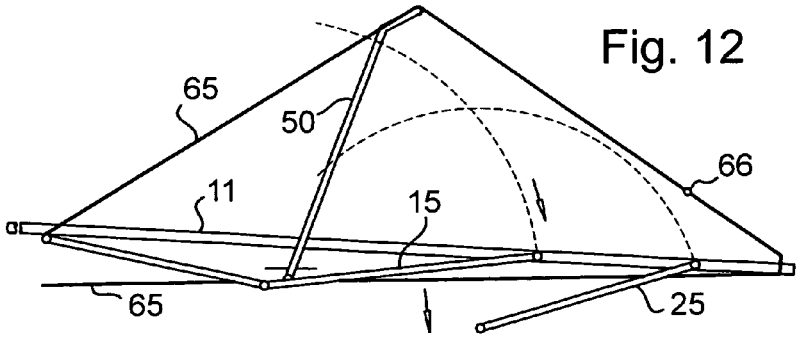
FIG. 12 is perspective schematic view of the operating components of the invention showing the mast in a horizontal position.

From FIG. 3 one can see the movement of the third frame with its cushioning roller 47 in the direction of the underside of the mast 11. In FIG. 4, the roller is in abutment to the mast. The fourth frame assumes a more vertical orientation as the pivotally and track mounted struts thereof are directed forwardly. When the mast has completed its travel to the vertical, the base of the mast is secured to the base on the roof of the cabin by the means aforementioned. The mast is supported and retained in a buttressed position by means of the first and second frames.

By gradually releasing the control line 65, the third frame under its own weight arcuately moves away from the mast to move out of the way of the boom and the associated items therewith.

To return the mast to a horizontal position, the base of the mast 11 is dismounted from the retaining pocket 74 on the roof of the cabin. The line 65 is payed from the winch (not shown) under aegis of the weight of the mast which moves under impingement of slight unbalancing. The mast moves to the horizontal in a reversal of its movement to the vertical. In the horizontal, the mast 11 extends about 3 feet in front of the sailboat. The mast comes to rest on the roller of the third frame. In order to be able to free line 65, an 18 inch vertical support is placed under the mast between it and the roof of the cabin. Another similar support is positioned under the mast to the fore.

Attention is drawn to FIGS. 5-12, for a clearer understanding of the unseating of the mast from the vertical and its positioning to the horizontal. Without the presence of extraneous rigging the drawings in FIGS. 5-12 the drawings are not only diagrammatic but are also schematic. They are deemed not require further elaboration.

Figure 13:
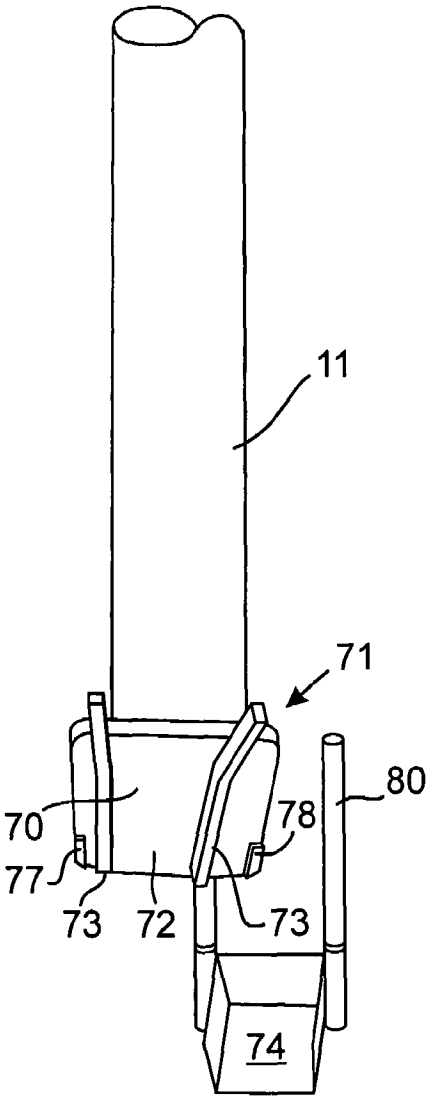
FIG. 13 is a partial view end of the bottom of the mast showing its position with respect to the receiving receptacle fastened. to the roof of the cabin.

FIG. 13 presents a close up view of the bottom of the mast which shows a shoe 71 which comprises a plate 72. The bottom of the plate 72 has two spaced downwardly extending flanges 73 which diverge and that extends forwardly beyond plate 72. The said plate also has two small lugs 77 and 78 which are positioned at opposite port and starboard side of the plate and extend downwardly therefrom. As the mast 11 assumes the vertical, it approaches the receptacle 74. The receptacle has a floor and has upstanding walls on three sides with no wall at the front. Egress and ingress of the plate and base of the mast is at the front opening resulting from the absence of an upstanding at the front of the receptacle. Suitably placed cotter pins or bolt holes may be positioned to retain the mast in place until it is desired to dismount the mast.

Figure 14:
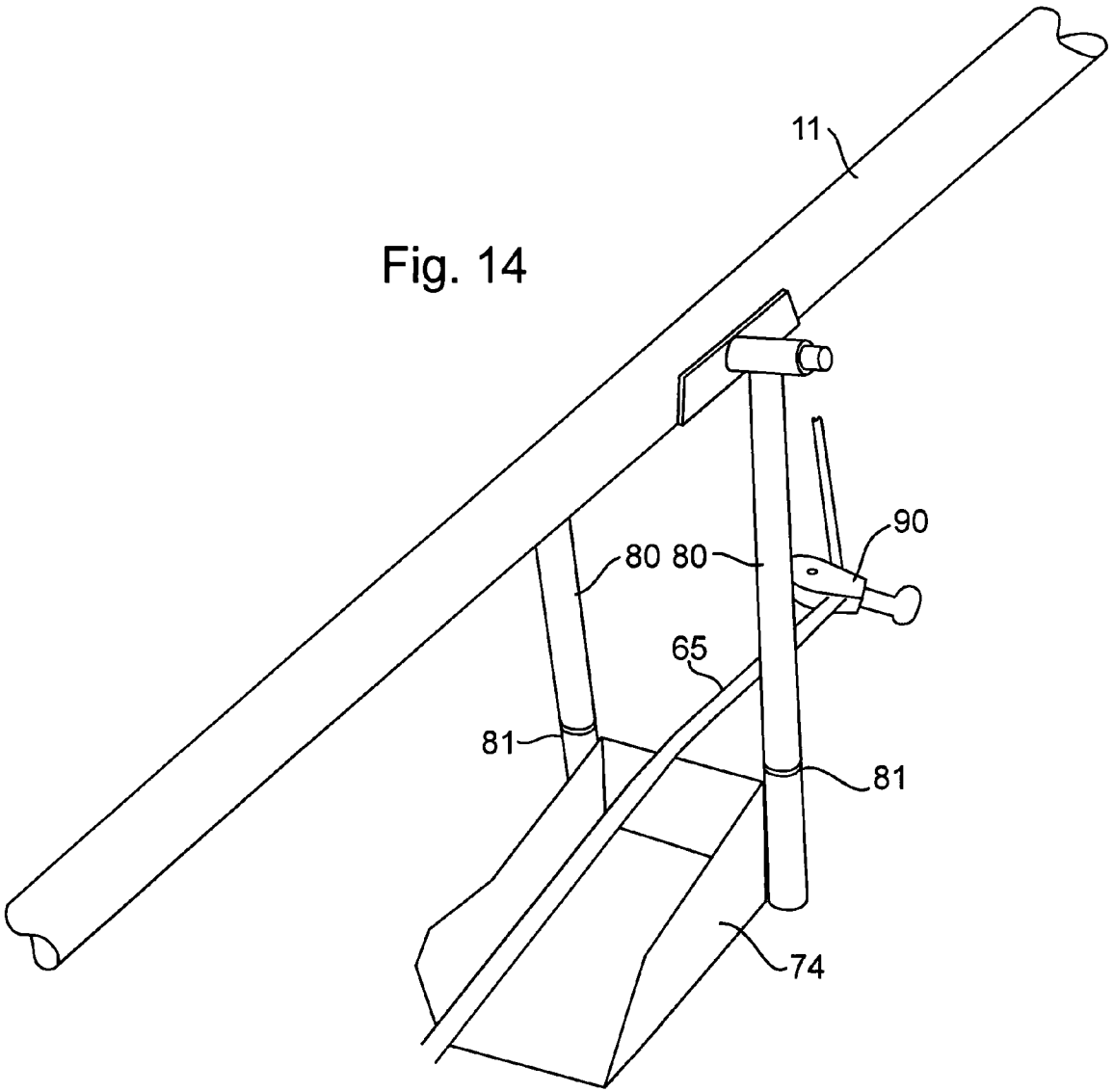
FIG. 14 is a partial view of the mast lying horizontally in abutment with a removable mast support which is a component of said receptacle.

FIG. 14 is another close up view of the receptacle 74 itself but this time with the mast 111 being positioned horizontally and partially supported by a vertical 18 inch prop 80 secured to one end of the aft end of the receptacle 74. The prop consists of two tubular uprights which are friction fitted into sockets 81 and a mast supporting cross piece thereon to a downwardly facing configuration. The control line 65 can be seen as it progresses aft and is guided by directional pulley 90 towards the take-up winch in the cockpit.

When taken in consideration together, the detailed description and figures presented herein describe a sailboat hoisting system which allows a single operator to raise and loser the mast, enhances safety of the raising and lowering operation, and allows easy installation and removal of the hoist without the need for permanent modification to the boat deck. It is also designed to use common components to lower manufacturing costs, and with an inventive mounting which allows a single embodiment to be mounted on many different sailboat designs. Even though detailed embodied are given herein, it will be understood by those well-versed in the art that many construction alternatives exist, and using any of those alternative constructions does not depart from the spirit of the invention.

I claim:

1. Rigging apparatus for raising a sailboat mast from a horizontal spaced relationship with respect to a hull of a sailboat to the vertical perpendicular position with respect to the hull of a sailboat or lowering the mast from said vertical perpendicular position with respect to the hull of a sailboat to the horizontal spaced relationship with respect to the hull of a sailboat, comprising elongated spreaders mounted on both starboard and port sides of the mast, said mast having one end which is the bottom portion when said mast in its vertical position, said bottom portion having a sheave box, a first frame, a second frame, a third frame and a fourth frame, each of said frames comprise a starboard side strut and a port side strut, each of said struts of each first frame and second frame describing a V-shaped configuration with each first and second frame having an apex pivotally connected to the mast, each of the ends of the struts of the said frames at the ends opposite to the respective apices being pivotally mounted to an upward facing surface of the boat, the struts of the first frame being aft of the mast when the mast is in a vertical position, the struts of the second frame being forward of the mast when the mast is in a vertical position, the ends of the said struts of the third frame being connected by a piece which is essentially perpendicular to the said ends of the struts and being detailed to support the mast when said mast is in its lowered position, the other ends of said struts being pivotally mounted aft of the mast when the mast is in a vertical position and being mounted pivotally to an upwardly facing surface of the boat, the fourth frame comprising two spaced apart struts, the said struts of the fourth frame having first ends and second ends, the said first ends being pivotally mounted aft of the mast when the mast is in a vertical position and being mounted pivotally to an upwardly facing surface of the boat, the second ends of the fourth frame being connected by a plate, said fourth frame being dimensioned whereby said fourth frame extends beyond said spreader of said mast and said plate extends forward of said mast when the mast is in a vertical position, a hoisting line attached between the piece of the third frame and the plate of the fourth frame, the hoisting line having one end attached to the said plate, extending to the bottom portion of the mast through the sheave box and payed aft to a take up means located in a rear portion of the boat whereby said mast is raised when said hoisting line is taken up and said mast is lowered to the horizontal when said hoisting line is unwound from said take up means.

2. The mast rigging apparatus of claim 1, wherein the apex portion of the first frame is split into two portions, one portion being pivotally mounted to the starboard side of the mast and the other portion being pivotally mounted to the port side of the mast, both below the spreaders.

3. The mast rigging apparatus of claim 1, wherein the struts of the fourth frame are longer than the other frames and extend freely above the said spreaders.

4. The mast rigging apparatus of claim 3, wherein the opposite struts are each slidably mounted to a separate track on the sailboat which extend fore and aft of the mast when said mast is in said vertical position.

5. The mast rigging apparatus of claim 1, wherein the struts of the first frame are stronger than other enumerated frames.

6. The mast rigging apparatus of claim 1, wherein the line attached between said piece of the third frame and the plate of the fourth frame comprises at least two separate shrouds whereby balance is obtained.

7. The mast rigging apparatus of claim 1, wherein a stop is attached to the hoisting line between said plate and said sheave box.

8. The mast rigging apparatus of claim 1, wherein the bottom of the mast when in the vertical perpendicular position rests on a retaining plate secured the hull of said sailboat.

9. The mast rigging apparatus of claim 1, wherein the piece of the third frame is fitted with a roller detailed to provide support to the mast when it is in a lowered horizontal position.

10. The mast rigging apparatus of claim 8, wherein the retaining plate has upright walls an opening at the front through which the bottom portion of the mast moves during the raising and the lowering of the mast.

11. The mast rigging apparatus of claim 10, wherein the said upright walls are provided with removable upright U-shaped support means adapted and constructed to support said mast when the mast is in a horizontal position.

12. The mast rigging apparatus of claim 11, wherein said bottom of said mast terminates in a shoe detailed to fit within said upright walls, said shoe comprising a plate having downwardly extending starboard and port side flanges.

13. The mast rigging apparatus of claim 12, wherein means is provided to lock said mast in said vertical perpendicular position.

14. A mast lifting and lowering system, comprising:

a sailboat having a mast pocket;

a mast having a top and a base and a pulley at the base, first and second frames connected to the sailboat and to the mast for stabilizing the mast and guiding the mast as it the mast is lifted and lowered;

third and fourth frames connected to the sailboat and erectable near the mast for assisting lifting and lowering the mast;

each frame having port and starboard struts on opposite sides of the mast, the first frame pivotally connected to the mast and pivotally connected to the sailboat aft of the mast pocket;

the second frame pivotally connected to the mast below a connection of the first frame and pivotally connected to the sailboat forward of the mast;

the third frame pivotally connected to the sailboat at lower ends of the port and starboard struts and having a mast-contacting support between the tops of the port and starboard struts;

the fourth frame pivotally connected to the sailboat at lower ends of the port and starboard struts and connected at a top forward of the mast;

a flexible connector connecting the tops of the third and fourth frames; and a lifting and lowering line connected to the top of the fourth frame, passing around the pulley at the base of the mast and passing aft for winching in to control raising of the mast and paying out to control lowering of the mast.

* * * * *